United States Patent [19]

Bromwell

[11] 3,944,223

[45] Mar. 16, 1976

[54] HOCKEY GAME APPARATUS

[75] Inventor: John J. Bromwell, Springtown, Pa.

[73] Assignee: The Raymond Lee Organization, Inc., New York, N.Y.

[22] Filed: Jan. 14, 1975

[21] Appl. No.: 541,006

[52] U.S. Cl. ..... 273/1 B; 273/126 R; 273/127 B

[51] Int. Cl.[2] ..... A63B 69/00

[58] Field of Search ..... 273/26 A, 105 R, 126 R, 273/127 R, 85 R, 1.5 A, 1 B, 55 R, 55 A, 85 D, 85 F, 181 A, 181 F, 181 J, 181 K, 181 R, 127 B

[56] References Cited

UNITED STATES PATENTS 2,944,816 7/1960 Dixon ..... 273/26 A 3,672,672 6/1972 Rubin ..... 273/26 A

*Primary Examiner*—Anton O. Oechsle
*Assistant Examiner*—T. Brown
*Attorney, Agent, or Firm*—Howard I. Podell

[57] ABSTRACT

A hockey type goal structure which may be readily set up in a yard, street or on ice. The goal is formed of a rectangular frame that supports a canvas sheet fitted with peripheral openings in a plane generally inclined to the horizontal surface on which the device is mounted. The canvas sheet is fastened by tension springs to a frame so that a ball or puck striking the canvas is rebounded away from the structure, while a ball or puck entering one of the peripheral openings is scored as a goal.

2 Claims, 2 Drawing Figures

HOCKEY GAME APPARATUS

SUMMARY OF THE INVENTION

My invention is a hockey type goal structure which may be readily set up in a yard, street or on ice. The goal is formed of a rectangular frame that supports a canvas sheet fitted with peripheral openings in a plane generally inclined to the horizontal surface on which the device is mounted. The canvas sheet is fastened by tension springs to a frame so that a ball or puck striking the canvas is rebounded away from the structure, while a ball or puck entering one of the peripheral openings is scored as a goal.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
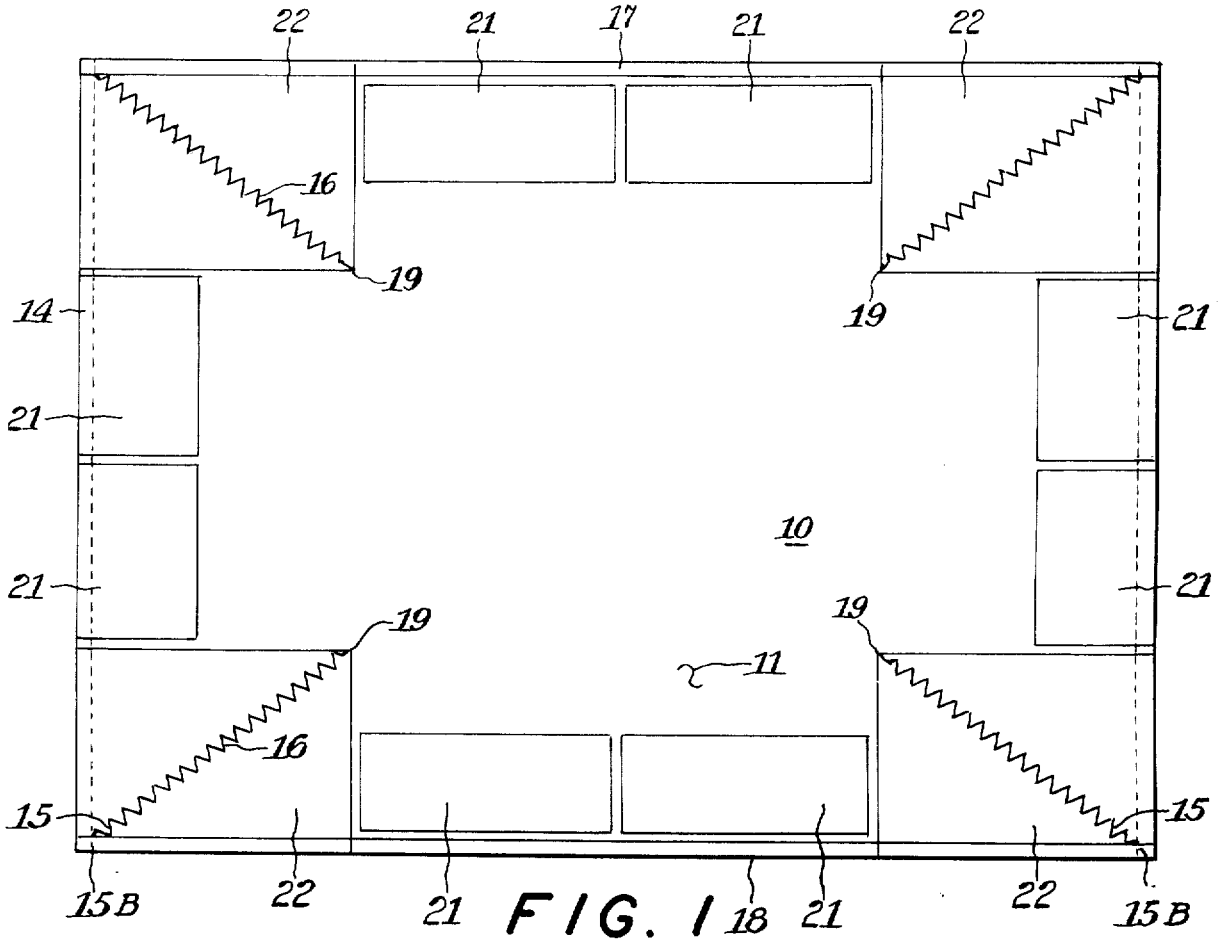
FIG. 1 is an elevation view of the goal structure.
Figure 2:
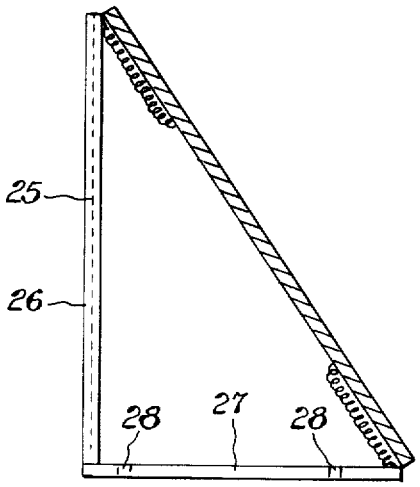
FIG. 2 is a sectional end view of the goal structure.

Turning now descriptively to the drawings, in which similar reference characters denote similar elements throughout the several views, FIGS. 1–2 illustrate the goal structure 10 which is formed of a canvas sheeting 11 or other sheet material suspended by a frame 25 that maintains the canvas sheeting 11 in a plane inclined to a horizontal playing surface, at the end of which the structure 10 is mounted.

Frame 25 consists of a pair of vertical posts 26, each joined to a horizontal bar 27, together with a top horizontal separator 17 joined to the top of the vertical posts 25 and a bottom horizontal separator 18 joined to the two bottom free ends 15 B of the horizontal bars 27.

Horizontal bars 27 and horizontal separators 17 may be fitted with through holes 28 for fastening to pegs or mounting stakes (not shown).

Sheeting 11 is cut with through peripheral openings 21 along its top, bottom and side borders and with through openings 22 formed in each corner of the sheeting 11.

The sheeting 11 is fastened to the top horizontal separator 17 and the bottom horizontal separator 18 and a tension spring 16 is fastened from an inside corner 19 of each corner opening 22 of the sheeting 11 to the frame 25 to maintain a rebound tension on the sheeting. The side edges 14 of the sheeting are fastened to stays that join the top of a vertical post 26 to the bottom of a horizontal bar 27.

When erected on a horizontal playing surface, the device serves as an automatic hockey type goal which does not require a goal tender. Shots of a puck, or a ball which strike the canvas 11 are rebounded back to the playing area, while a puck or ball that is directed to go through a border opening 21 or a corner opening 22 are not rebounded, but scored as goal points.

The device 10 may be used for practice of hockey.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A hockey puck of official and conventional size and shape and a hockey type goal structure formed of a substantially rectangular sheet of flexible material supported by springs to a substantially rectangular frame structure so that said sheet lies at an angle to a horizontal plane upon which the frame rests, said sheet being provided with through openings along its periphery, said openings being of a size to permit passage of the hockey puck therethrough.

2. The combination as recited in claim 1 in which said through openings are rectangular-shaped and are provided in the sheet at each corner thereof, each said opening being oriented so that an inside corner thereof is at a distance from a corner of said frame structure, each provided with a tension spring means extending between each inside corner of each said corner opening and the nearest corner of the frame so as to tension and maintain the sheet taut.

* * * * *